United States Patent [19]

Carey

[11] Patent Number: 5,029,394

[45] Date of Patent: Jul. 9, 1991

[54] ROUTER TEMPLATE ASSEMBLY FOR USE IN HANGING DIFFERENT SIZED DOORS

[76] Inventor: John Carey, 1996 Milford Pl., El Cajon, Calif. 92020

[21] Appl. No.: 526,020

[22] Filed: May 21, 1990

[51] Int. Cl.[5] ..... E06B 3/00

[52] U.S. Cl. ..... 33/194; 33/197; 33/562

[58] Field of Search ..... 33/194, 197, 667, 562

[56] References Cited

U.S. PATENT DOCUMENTS

| | | | |
|---|---|---|---|
| 1,644,666 | 10/1927 | Carter | 33/197 |
| 1,788,256 | 1/1931 | Sherwin | 33/197 |
| 2,660,803 | 12/1953 | Sacrey | 33/197 |
| 2,670,546 | 3/1954 | Godfrey | 33/197 |
| 2,869,245 | 1/1959 | Bork | 33/197 |
| 2,927,378 | 3/1960 | Godfrey et al. | 33/197 |
| 3,203,104 | 8/1965 | Heathington | 33/667 |
| 3,206,861 | 9/1965 | Banijonaitis et al. | 33/197 |
| 3,738,013 | 6/1973 | Gregory | 33/562 |
| 4,400,886 | 8/1983 | Bindschatel | 33/562 |

*Primary Examiner*—William A. Cuchlinski, Jr.
*Assistant Examiner*—Alvin Wirthlin
*Attorney, Agent, or Firm*—Charles C. Logan, II

[57] ABSTRACT

The router template assembly has structure which allows it to be used in mounting 6' 8" doors, 7' doors and 8' doors. The assembly when temporarily nailed to the interior of a door jamb provides cutout portions located at positions where a top hinge, a center hinge, and a bottom hinge would be mounted. A router is used in each of these cutout portions to form the proper recesses in the door jamb for the respective hinges. The router template assembly can also be temporarily nailed onto the edge of the door which automatically positions the cutout portions where the recesses in the door should be formed for the respective hinges. The router template assembly has telescoping extension members with predetermined locking positions so that it can be automatically adjusted for the size of the door to be installed.

5 Claims, 4 Drawing Sheets

ROUTER TEMPLATE ASSEMBLY FOR USE IN HANGING DIFFERENT SIZED DOORS

BACKGROUND OF THE INVENTION

The invention relates to a router template and more specifically one to be used when routing the recesses in door jambs and doors for specific sizes of door hinges.

Presently, the majority of doors are mounted in door jambs by a carpenter measuring and marking locations on the door jamb where the hinge recesses should be cutout. Also he must make the specific measurements on the door itself and mark where the hinge recesses should be cutout. The process of measuring all the required dimensions is time consuming and costly for a building contractor.

One attempt to speed up the process of hanging a door has been to make a template for each of the respective sizes of doors generally used in houses and buildings. These are generally identified as a 6'8" door, a 7' door, and an 8' door. A fixed height router template assembly is relatively expensive and a carpenter to be properly prepared would need a router template for each of the respective sizes of doors.

It is an object of the invention to provide a novel router template assembly that is adjustable so that it can be used with 6'8" doors, 7' doors, and 8' doors.

It is also an object of the invention to provide a novel router template assembly that is adjustable for mounting new doors where the existing hinges have been placed at heights that are not generally used by carpenters.

It is another object of the invention to provide a novel router template assembly that is lightweight and yet rigid due to the material from which the router template assembly is made.

It is an additional object of the invention to provide a novel router template assembly that is economical to manufacture and assembly.

SUMMARY OF THE INVENTION

The novel router template assembly has been designed for use in hanging different sized doors. The height of most common doors are 6'8", and some commercial doors are 7' or 8' doors. By using a template, it is possible to guide a router in a pattern to the exact shape and depth of the recesses needed for mounting hinge members therein.

Since the novel router template assembly has structure which allows its length to be adjusted, this allows it to be used with the three most common heights of doors. The adjustments in length are made by telescopically adjusting the respective members to predetermined locking positions. This eliminates any necessity for measuring the distance to adjust the individual components. The use of the template assembly has already eliminated the need to make measurements on the door jamb or door to find the proper position where the hinge recesses would be cut.

The template cutout portions around which the router bit traverse can have their length adjusted so that the router template assembly can be used with the two most popular hinge sizes on doors, ($3\frac{1}{2}\times3\frac{1}{2}$ and $4\times4$). The adjustment for the size of the hinge is accomplished by longitudinal movement of the sliding plates that are secured by a pin in a spring clip being received in one of two holes in the sliding plate to thereby change the length of the template cutout portion. There is no adjustment required for the width of the cutout portion.

The adjustment for the standard spacing between the hinges is accomplished by telescopically adjusting each of the extension members longitudinally with respect to the lefthand template section and the righthand template section. The extension members each have predetermined longitudinally spaced apertures therein which receive the pin of a spring clip secured to the respective template sections. The spacing of these apertures is such that the template assembly can automatically be adjusted to be used with a 6'8" door, a 7' door, or an 8' door.

Adjustable length fingers are secured to the respective top and bottom ends of the template assembly and these provide a set spacing from the top and bottom of the door jamb to the respective top and bottom hinges. The adjustable length fingers also have structure on their ends that provide an automatic proper positioning of the hinge recesses on the door and provide the required $\frac{1}{8}$ of an inch gap at the top and bottom of the door jamb.

The router template assembly has structure that allows double head nails to temporarily secure the router template assembly to either the door jamb or the door itself.

The router template assembly also has structure that aids in positioning the router template assembly against the door jamb or against the door prior to the template assembly being temporarily nailed thereto. This structure takes the form of a rotating door stop that is mounted on the rear surface of one of the template sections. It consists of a block that is eccentrically pivoted about an axis perpendicular to the rear of the template seciton. It engages the outer edge of the door jamb to prevent the template assembly being positioned too far inwardly when it is temporarily nailed thereto. In one position of the door stop, it is set up to accurately position the template assembly for a door having a $1\frac{3}{8}$ inch thickness. When the door stop is rotated 180 degrees, it will accurately position for a door having a $1\frac{3}{4}$ inch thickness. The rotating door stop is also used when positioning the router template assembly on the door itself before it is temporarily nailed thereto.

DESCRIPTION OF THE PREFERRED EMBODIMENT

Figure 6:
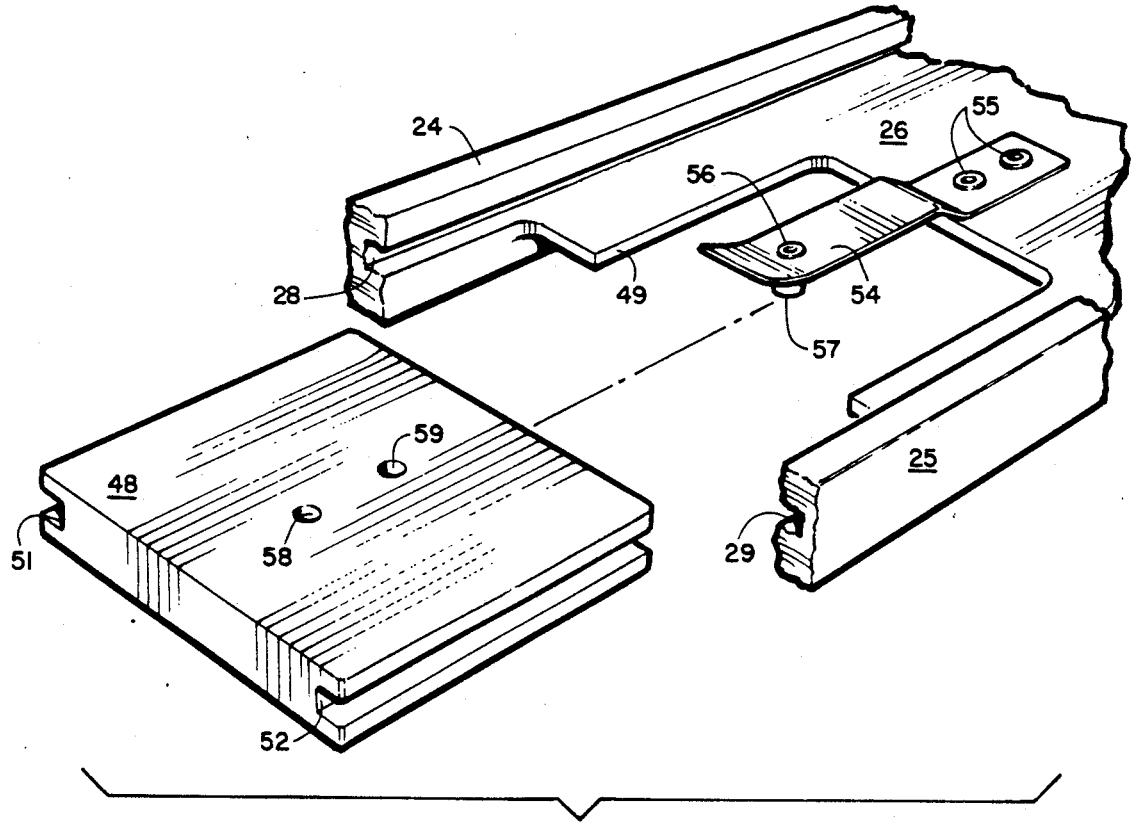
FIG. 6 is an exploded partial top perspective view of one of the hinge template cutout portions.
Figure 1:
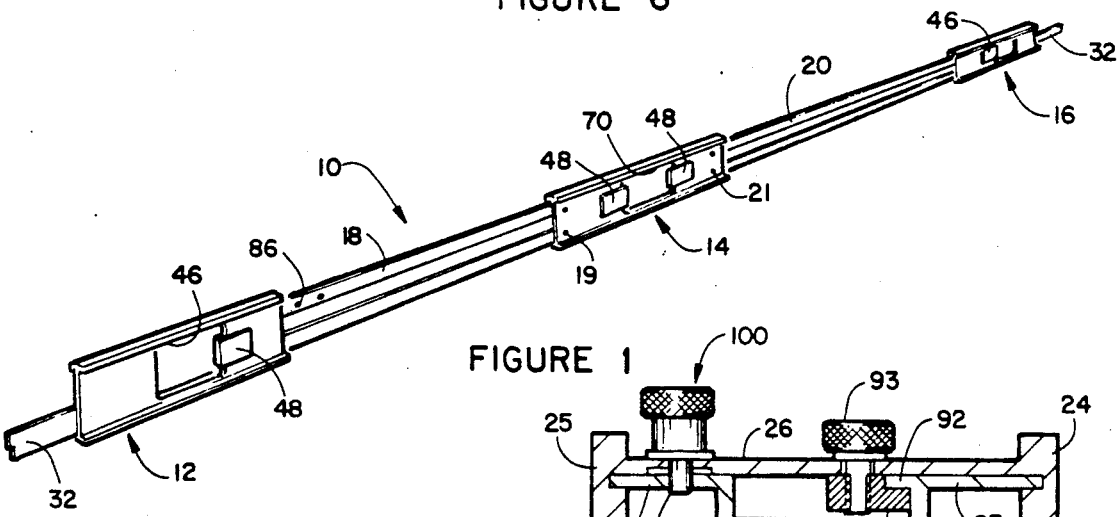
FIG. 1 is a front perspective view of the novel router template assembly.

Applicant's novel router template assembly will now be described by referring to FIGS. 1–7 of the drawings. The router template assembly is generally designated numeral 10.

Router template assembly 10 has three major components, lefthand template assembly section 12, center template section 14, and righthand template section 16. Extruded extension member 18 is rigidly attached to one end of center template section 14 by rivets 19. Extruded extension member 20 is rigidly secured to the other end of center template section 14 by rivets 21.

Figure 3:
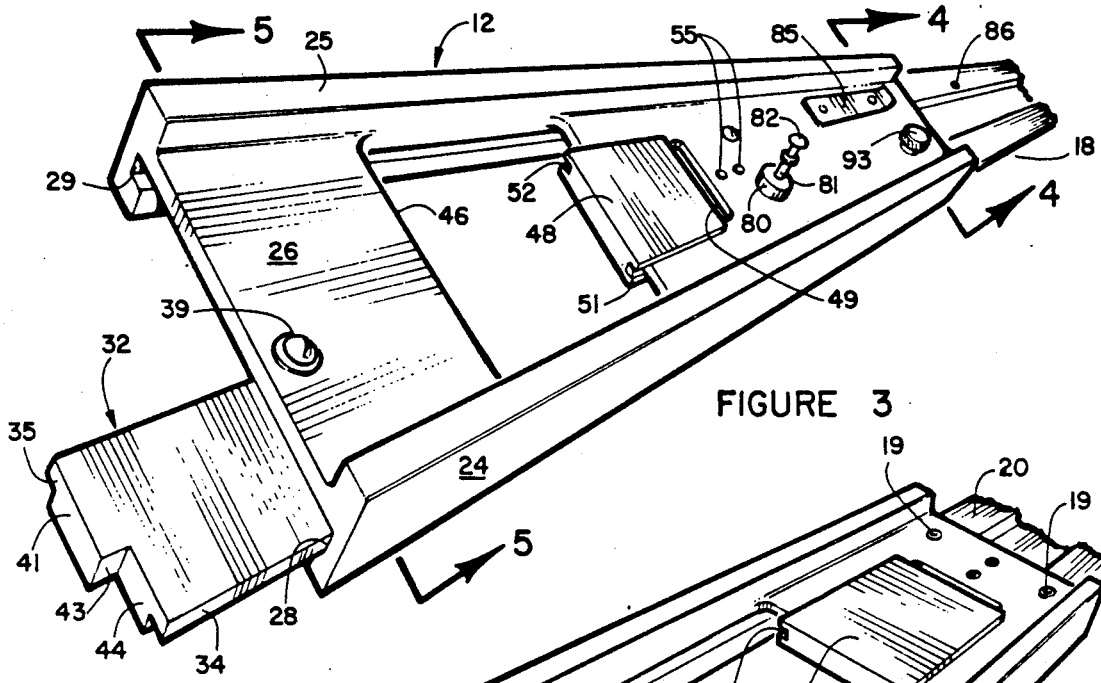
FIG. 3 is a top perspective view of the lefthand template section.

Lefthand template section 12 is illustrated in FIG. 3 and its specific structure will be discussed by referring thereto. Lefthand template section 12 is preferably formed from extruded aluminum material and it has an I-beam cross sectional configuration. It has a bottom rail 24 and a top rail 25 that are connected together by web 26. Bottom rail 24 has a U-shaped channel 28 formed therein and a U-shaped channel 29 is formed in top rail 25. These channels extend throughout the longitudinal length of lefthand template section 12 and provide a mating structure for telescopically receiving one end of the extruded extension member 18.

An adjustable length stop member 32 is telescopically received in the lefthand template section 12. It has a flange 34 that mates with U-shaped channel 28. A second flange 35 is captured by locking member 37 that has a finger 38 that is drawn into frictional engagement thereto by bolt 39. Adjustable length stop member 32 has a top end surface 41 that is normally placed against the top of the door jamb. The distance from end surface 41 to the top of the position where the hinge would be placed is normally seven inches. A notch 43 is formed in end surface 41 and this provides a second end surface 44 that is positioned adjacent the top edge of the door before the router template assembly is temporarily nailed thereto. End surface 44 is ⅛ of an inch recessed from end surface 41 and this provides the normal spacing between the top of the door and the door jamb when the door is properly mounted.

Template cutout portion 46 extends from bottom rail 24 to top rail 25. The length of the cutout portion is adjustable by moving sliding plate 48 longitudinally in cutout slot 49. Channels 51 and 52 travel along the lateral edges of cutout slot 49. The locking structure for sliding plates 48 is best understood by referring to FIG. 6 which shows the back of lefthand template section 12. Spring clip 54 has its one end secured to lefthand template section 12 by rivets 55. A rivet 56 secures a pin 57 to the opposite end of spring clip 54. Pin 57 is removably engagable in bore recesses 58 and 59. When pin 57 is engaged in bore recess 58, the template cutout portion is set for 4×4 inch hinges. When pin 57 is set in bore recess 59, the template cutout portion 46 is set for 3½×3½ inch hinges. Lefthand template section 12 and righthand template section 16 are substantially identical but reversed in orientation.

Figure 2:
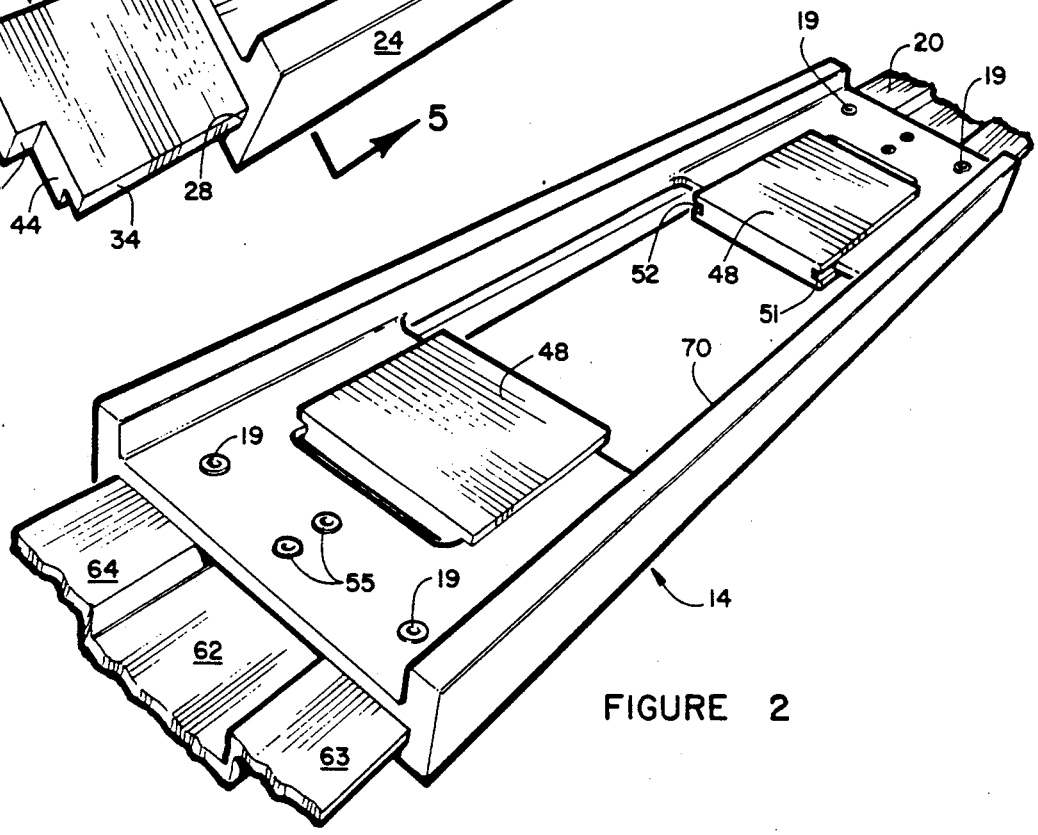
FIG. 2 is a top perspective view of the center template section.
Figure 5:
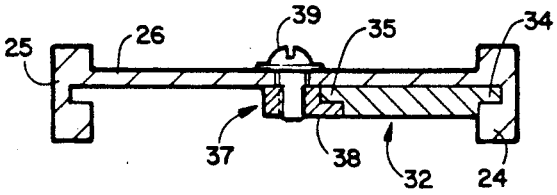
FIG. 5 is a cross sectional view taken along lines 5—5 of FIG. 3.

In FIG. 2, the cross sectional configuration of extruded extension members 18 is illustrated. It has a hat shaped cross section formed from a top cross member 62 and flanges 63 and 64. Flanges 63 and 64 are matingly received in the U-shaped channels 28 and 29 of the respective lefthand template section 12 and righthand template section 16. Center template section 14 has a template cutout portion 70 and it is longitudinally extendable in both of its opposite directions by sliding plates 48 whose structure is the same as that illustrated in FIG. 6 and which function in the same manner. Spring clips 54 are mounted on the rear surface of top cross member 62 by rivets 55. Extruded extension member 20 has an identical structure to that of extruded extension member 18 and the manner in which it is attached to the respective center template section 14 and righthand template section 16 is the same as has been described for lefthand template section 12 and center template section 14.

The structure for temporarily securing the router template assembly 10 to either the door jamb or the door is seen in FIG. 3. A boss 80 having a bore 81 that passes entirely through the width of lefthand template section 12 has a double headed nail 82 received therein. There is a similar double headed nail 82 mounted in identical structure on righthand template section 16. When the router template assembly is properly positioned on either the door or door jamb, double head nails 82 are pounded into the adjacent structure and the template cutout portions are in their proper position for using the router to form the recesses for the hinges.

Figure 4:
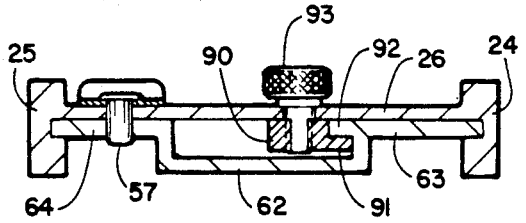
FIG. 4 is a cross sectional view taken along lines 4—4 of FIG. 3.
Figure 8:
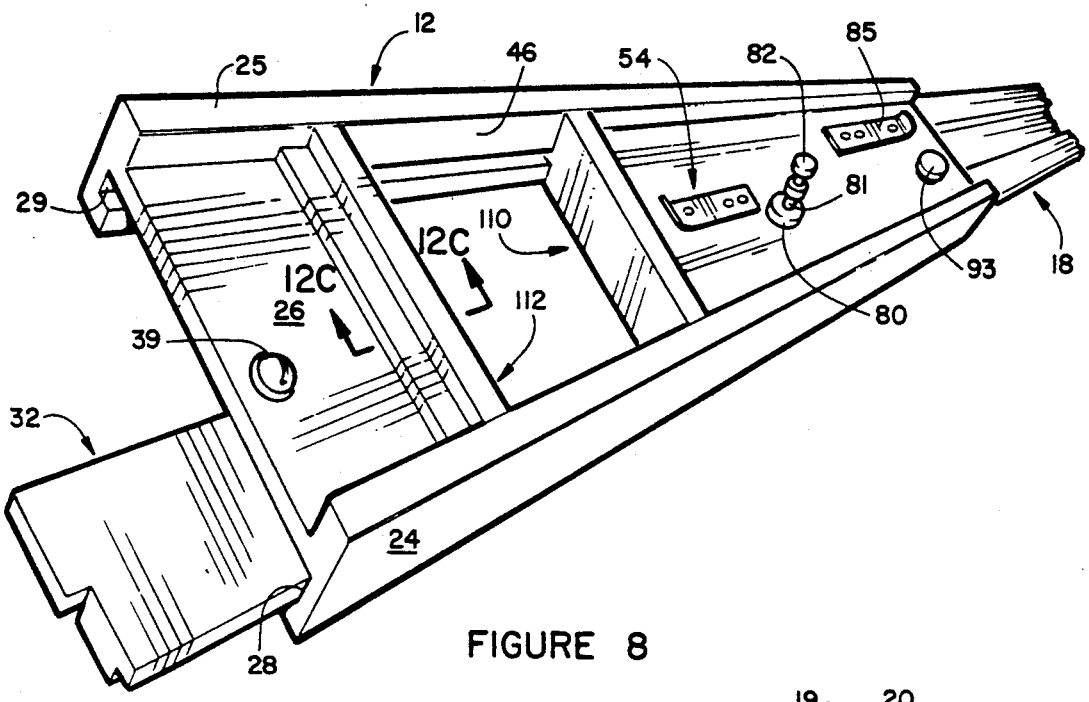
FIG. 8 is a top perspective view of the lefthand template section showing the use of an alternative form of sliding plate.
Figure 9:
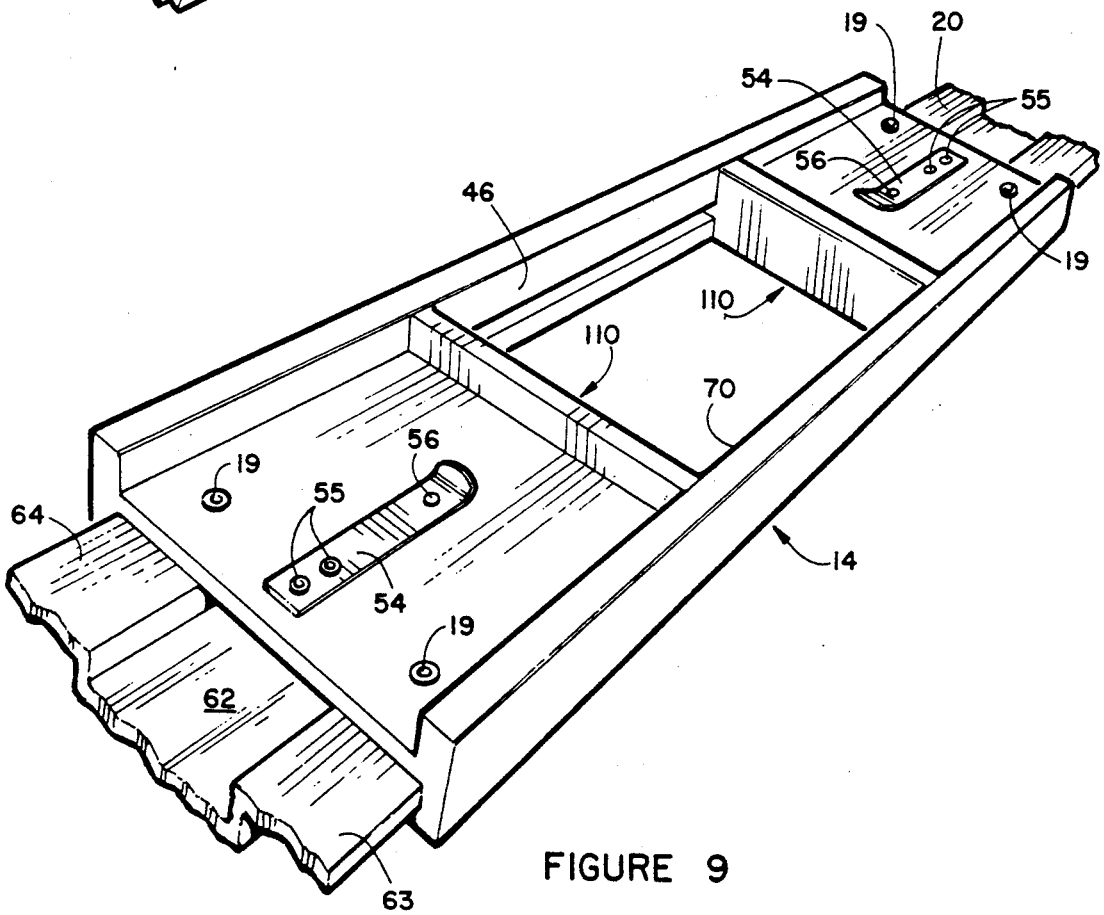
FIG. 9 is a top perspective view of the center template section showing the use of two of the alternative embodiment sliding plate members.
Figure 10:
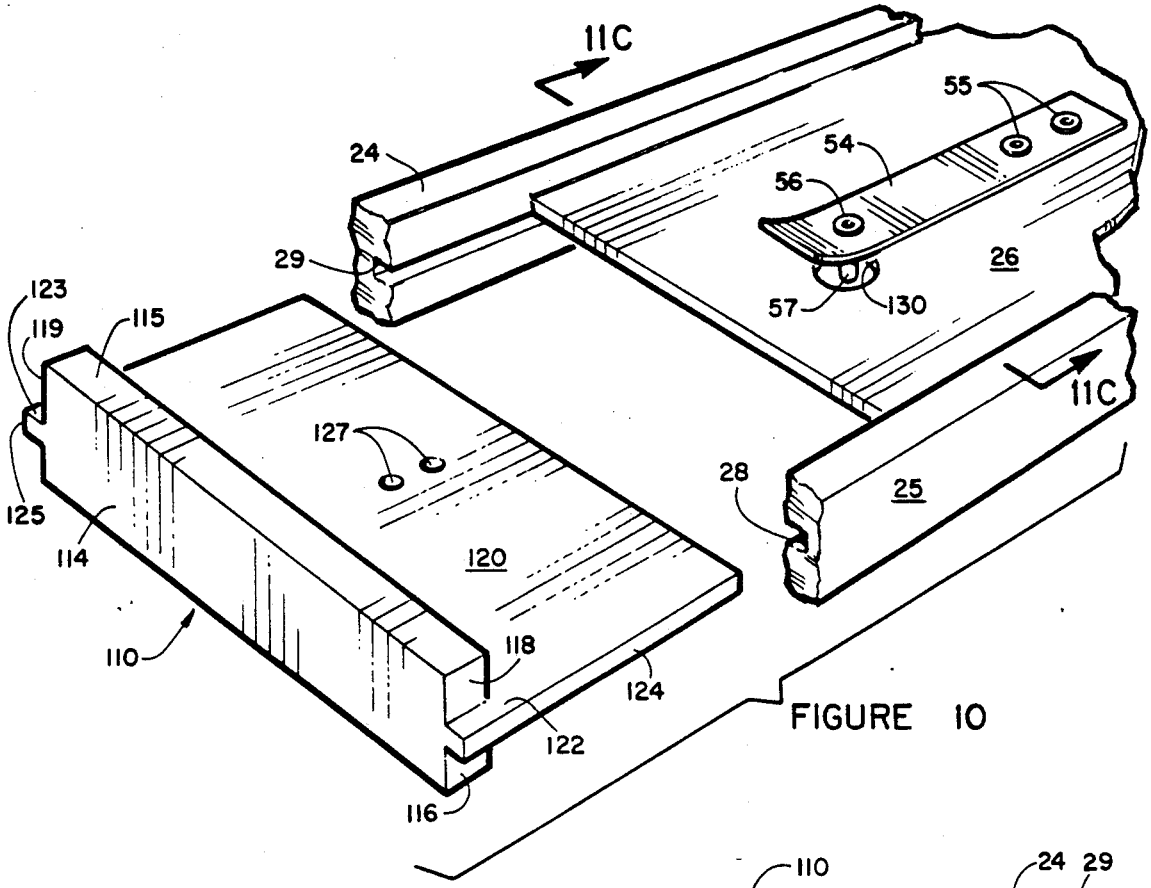
FIG. 10 is an exploded partial top perspective view of one of the template cutout portions showing the alternative embodiment sliding plate.
Figure 12C:
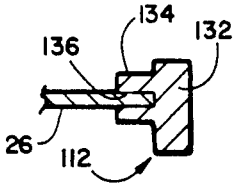
FIG. 12C is a cross sectional view taken along lines 12C—12C of FIG. 8.
Figure 12A:
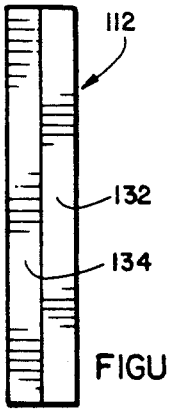
FIG. 12A is a top plan view of the stationary frame member positioned in the template cutout portion of FIG. 8.
Figure 11A:
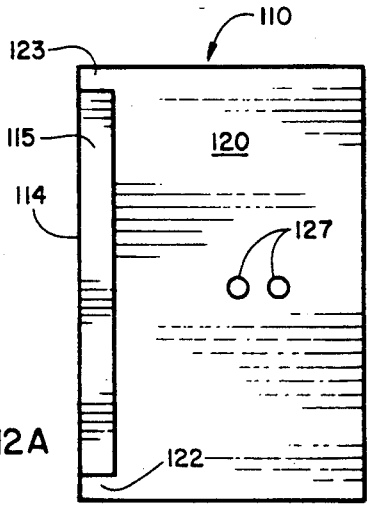
FIG. 11A is a top plan view of the alternative embodiment sliding plate.
Figure 11C:
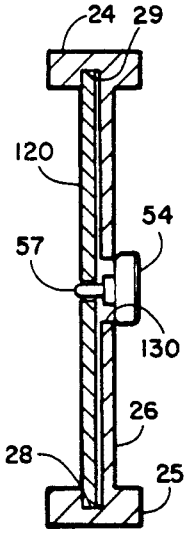
FIG. 11C is a cross sectional view taken along lines 11C—11C of FIG. 10.
Figure 12B:
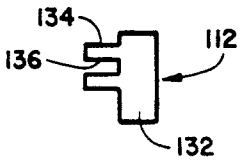
FIG. 12B is a side elevation view of the stationary frame member.
Figure 11B:
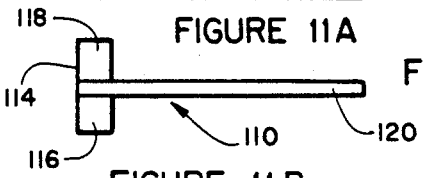
FIG. 11B is a side elevation view of the alternative embodiment sliding plate.

Spring loaded keepers 85 are similar in structure to spring clips 54. They also have pins 57 and these are matingly received in apertures 86 that are longitudinally spaced along extruded members 18 and 20. The spacing of these respective apertures 86 are such that by having a series of three apertures in each of the respective extruded extension members, it is possible to have predetermined settings for the router template assembly to have an overall length of 6'8", 7', or 8'. In FIG. 4, the structure of the spring loaded keeper 85 is illustrated. A locking plate 90 has a flange 91 that frictionally engages a flange 92 of one of the extension members. Adjustment bolt 93 when tightened into the internal threaded bore of locking plate 90 will grip the template section to its respective extension member. Adjustment bolt 93 is used when the spacing on existing hinges in a door jamb are not consistent with the standard distances used by most carpenters.

Figure 7:
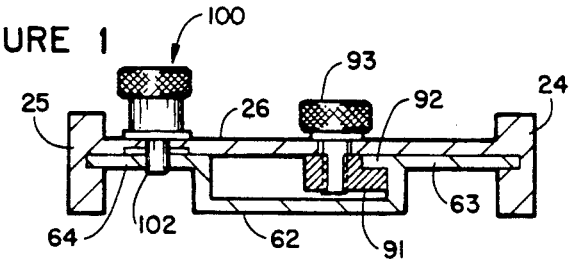
FIG. 7 is a cross sectional view illustrating an alternative structure for locking the telescoping members of the router template assembly together.

An alternative structure for spring loaded keeper 85 is illustrated in FIG. 7. It is a spring loaded keeper 100 having an internal compression spring that causes pin 102 to be extended outwardly therefrom. Pin 102 is retractably inserted into one of the apertures 86 of the extension member. The remainder of the structure in FIG. 7 is substantially identical to that seen in FIG. 4.

An alternative sliding plate 110 and a stationary frame member 112 are illustrated in FIGS. 8–12C. Sliding plate 110 has a front wall 114 formed from top ridge 115 and bottom ridge 116. Front wall 114 has side edges 118 and 119. A horizontal panel portion 120 extends rearwardly from front wall 114 and it has a width wider than front wall 114 which forms flanges 122 and 123. These respective flanges have side edges 124 and 125. A pair of apertures 127 are formed in horizontal panel portion 120. Flanges 122 and 123 are slidingly received in U-shaped channels 28 and 29. Pin 57 of spring clip 54 passes through aperture 130 in web 26 and is removably received in one of the apertures 127. Stationary frame member 112 has a front wall 132. A rear protrusion 134 has a horizontal channel 136 that frictionally engages web 26 of the template cutout portion 46.

What is claimed is:

1. A router template assembly for use for hanging different sized doors comprising:

an elongated lefthand template section having an I-beam crossectional configuration formed from a top rail and a bottom rail that are connected together by a web member, said bottom rail and top rail each having a U-shaped channnel adjacent said web member, said lefthand template section having a left end, a right end, and a longitudinally extending axis, a door bottom hinge template cutout portion is formed in said web member intermediate the left and right ends of said lefthand template section at a predetermined location;

an elongated center template section having an I-beam crossectional configuration formed from a top rail and a bottom rail that are connected together by a web member, said bottom rail and top rail each having a U-shaped channel adjacent said web member, said center template section having a left end, a right end, and a longitudinally extending axis, a door middle hinge template cutout portion is formed intermediate the left and right ends of said center template section at a predetermined location;

a first elongated extension member having a left end, A right end, and a longitudinally extending axis, means for rigidly attaching one end of said first extension member to one end of said center template section, means for telescopically connecting the other end of said first extension member to the right end of said lefthand template section and first locking means for securing the first elongated extension member and the lefthand template section together so that they may have a predetermined combined length;

an elongated righthand template section having an I-beam crossectional configuration formed from a top rail and a bottom rail that are connected together by a web member, said bottom rail and top rail each having a U-shaped channel adjacent said web member, said righthand template section having a left end, a right end, and a longitudinally extending axis, a door top hinge template cutout portion is formed intermediate the left and right ends of said righthand template section at a predetermined location;

a second elongated extension member having a left end, a right end, and a longitudinally extending axis, means for rigidly attaching one end of said second extension member to one end of said center template section, means for telescopically connecting the other end of said second extension member to the left end of said righthand template section and second locking means for securing the second elongated extension member and the righthand template section together so that they may have a predetermined combined length; and means for adjusting the length of the template cutout portion in each of said template sections so that different sized hinges can be used to mount a door comprising: at least one sliding plate in each of said hinge template cutout portions, said sliding plates each having a panel portion having a top edge and a bottom edge that are slidingly received in the respective U-shaped channels, each said sliding plate having a front wall attached thereto, said wall extending above and below each said sliding plate, at least two apertures in said panel portion, an elongated spring for each sliding plate, said spring clips having a front end and a rear end, said rear end being rigidly fastened to said web member at a predetermined position, said front end having a pin secured thereon that is selectively received in one of the apertures in said panel portion depending upon the size of the hinge to be mounted.

2. A router template assembly for use in hanging different sized doors as recited in claim 1 further comprising means for temporarily nailing said router template assembly to a door jamb or door while a router is used to cutout the recesses where the hinges are mounted.

3. A router template assembly for use in hanging different sized doors as recited in claim 1 wherein said three template sections and said two extension members are made of extruded aluminum.

4. A router template assembly for use in hanging different sized doors as recited in claim 1 further comprising a first adjustable length finger and means for locking it so that it protrudes a predetermined distance from the left end of said lefthand template section so that a door hinge would be spaced a specific height from the top of a door jamb, and a second adjustable length finger and means for locking it so that it protrudes a predetermined amount from the right end of said righthand template section so that a door hinge would be spaced a specific height from the bottom of the door jamb.

5. A router template assembly for use in hanging different sized doors as recited in claim 4 wherein each of said fingers have an outer end having a notch therein that provides means for aligning the router template assembly with the respective top and bottom surfaces of a door.

* * * * *